US006811453B2

(12) United States Patent
Williams

(10) Patent No.: US 6,811,453 B2
(45) Date of Patent: Nov. 2, 2004

(54) TINE EDGE ELECTRICAL CONTACT

(76) Inventor: Roger C. Williams, 2024 Pueblo Ct., Santa Rosa, CA (US) 95409

( * ) Notice: Subject to any disclaimer, the term of this patent is extended or adjusted under 35 U.S.C. 154(b) by 0 days.

(21) Appl. No.: 09/916,749

(22) Filed: Jul. 27, 2001

(65) Prior Publication Data

US 2002/0086589 A1 Jul. 4, 2002

Related U.S. Application Data

(60) Provisional application No. 60/221,612, filed on Jul. 28, 2000.

(51) Int. Cl.[7] ..... H01R 13/187

(52) U.S. Cl. ..... 439/843; 439/852; 439/862

(58) Field of Search ..... 439/842–843, 439/852–85, 859–862, 856

(56) References Cited

U.S. PATENT DOCUMENTS 3,842,497 A * 10/1974 Kehl et al. ..... 29/628
4,734,064 A * 3/1988 Knapp et al. ..... 439/852
5,135,418 A * 8/1992 Hatagishi et al. ..... 439/857
6,250,974 B1 * 6/2001 Kerek ..... 439/843

* cited by examiner

*Primary Examiner*—Truc T. T. Nguyen
(74) *Attorney, Agent, or Firm*—Risto A. Rinne, Jr.

(57) ABSTRACT

An apparatus for forming and disconnecting an electrical path includes a split tine socket that is formed of a high yield strength conducting material or metal and which includes a plurality of tines. Each tine functions as a two stage spring to supply a normal force that urges the tine toward the center of the socket. Each tine includes a first stage that has a smaller inside diameter and is therefore thicker than an adjacent second stage. The outside diameter of both stages includes a taper so that the tines are nearly cylindrical when fully mated with a pin. The second stage includes a reverse taper whereby it has a larger inside diameter proximate the first stage than at an opposite end proximate a tip, which ensures that physical, and therefore electrical, contact with the pin will occur at the tip of the tine. The first stage is in electrical contact with a socket contact portion that is typically crimped or soldered onto a wire. A plurality of sockets are typically included in a connector. Each tine includes an inside radius that is less than the radius of the pin that is intended to mate with the socket and therefore, each tine forms two longitudinal patches of electrical contact with the pin at the outside edges of each tine.

10 Claims, 3 Drawing Sheets

TINE EDGE ELECTRICAL CONTACT

This application claims the benefit of priority of Provisional Patent Application Ser. No. 60/221,612 that was filed on Jul. 28, 2000.

BACKGROUND OF THE INVENTION

1. Field of the Invention

The present invention, in general relates to electrical contacts and, more particularly, to electrical contacts that permit maximal current flow with minimal insertion force.

The pin and socket configuration of electrical contacts is common in a variety of industries and frequently includes a solid pin contact that mates to a slotted or "split tine" type of a socket contact.

The split tine socket is typically deformed radially inward after machining in order to achieve an adequate normal force when mated to the pin contact. This deformation is sometimes referred to as a "set".

Another method of achieving inward normal force on the pin contact is the use of a separate coil spring or "C" clip spring that is wrapped around the tip of the tines and which tends to urge them inward, toward the pin.

A common type of problem that occurs generally with these types of contacts involves achieving a consistent normal force. A consistent normal force results in consistent mate/unmate forces and also in a consistent, and preferably, low voltage drop across the connection.

Maintaining a consistent normal force over the life of the contact, which may be subjected to harsh environments and abuse, remains a vexing problem in the industry.

These issues are especially important when high currents are involved, such as when fast charging electric vehicles. Also, the connectors that utilize these types of contacts may be handled by personnel with limited strength.

It is desirable that such contacts have low mate and unmate forces and that those forces remain relatively constant throughout the connector's useful service life.

If the mate/unmate force is too high, the connector, having a plurality of contacts, may be unusable by some people of limited strength. Conversely, if the contacts loosen excessively over time (i.e., if the normal force decreases substantially), a resulting increase in resistance and therefore voltage drop can occur. This, in turn, will cause a rise in temperature and may result in an unsafe situation.

Setting the tines of the contact requires using a material with a sufficiently low yield strength such that sufficient permanent deformation can take place within the constraints of the slit width, in order to achieve the desired normal force.

Unfortunately, permanent deformation in the outward radial direction or "loosening" can occur over the life of the contact resulting in a reduction of normal force and an increase in voltage drop. Loosening is a common problem with connectors that are mated and unmated repeatedly.

This is especially true when the connector design allows a rocking motion to be used as an aid in mating and unmating. Installing an external helper spring wrapped around the tip of the tines can help alleviate this problem because the spring is made of a high yield strength material that is resistant to permanent deformation.

However, the external spring's spring rate, dimensions, and frictional characteristics contribute to a variation in normal force. Also, the frictional characteristics of the spring/tine interface are subject to change over the life of the contact, especially in harsh environments. Furthermore, this approach tends to increase the mate/unmate forces that are required. It also adds one more component part (i.e., the external spring) to the assembly of each contact.

Also, prior art design of contacts, especially high current contacts, has been based on the prevailing assumption that it is desirable to maximize the contact area intermediate a pin and a socket. The more contact area that occurs at the interface between the pin and the socket, it has been believed, will increase the opportunity for current to flow. It has been thought that current flow will occur at least somewhere wherever there is the potential for physical contact to occur, so the greater the potential for that contact to occur and to occur in as many places as possible, became the essence of optimum high current contact design theory.

It was further believed that a great amount of surface area for contact is absolutely necessary to support high current loading through the connector. The problem with maximizing contact area is that, for any given tine to pin pressure (i.e., normal force), a greater area for contact results in less normal force being applied at any given location. This tends to result in random spots of contact occurring. If contact is random, there is little assurance that any mechanical "wiping" will clean the pin and tines at the exact areas where physical contact will occur.

This, it has been found, decreases the current carrying ability of a contact over its life because oxidation that occurs is not optimally cleaned by the wiping action of the tine with the pin. Also a lower normal force also tends to increase electrical resistance in general.

Accordingly, there exists today a need for an electrical contact that is durable and reliable, adaptable for use in harsh environments, requires a minimal mate/unmate force, and is capable of carrying high currents.

2. Description of Prior Art

Electrical contacts are, in general, well known. While the structural arrangements of the known types of devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an electrical contact that lessens the mate and unmate forces that are required.

It is also an important object of the invention to provide an electrical contact that is durable.

Another object of the invention is to provide an electrical contact that increases the current carrying ability of the contact.

Still another object of the invention is to provide an electrical contact that uses the tines as springs to supply a normal force.

Still yet another object of the invention is to provide an electrical contact that is adapted to distribute stress along its longitudinal length.

Yet another important object of the invention is to provide an electrical contact that includes limited areas, or patches, of physical contact intermediate a pin and tine.

A still further object of the invention is to provide an electrical contact that includes predictable areas of physical contact to occur intermediate a pin and tine.

A still further important object of the invention is to provide an electrical contact that provides a wiping action of the tine upon the pin which tends to clean that specific area of the pin with each mating/unmating cycle.

Still yet another important object of the invention is to provide an electrical contact that includes a reverse taper of a portion of a tine.

Still yet one further object of the invention is to provide an electrical contact that includes a two-stage tine.

Still yet one further important object of the invention is to provide an electrical contact that includes a socket with at least one tine that has a first inside radius and a pin that has a second outside radius where the outside radius of the pin is greater than the first inside radius of the tine, which results in contact occurring intermediate the tine and the pin longitudinally along a portion of the inside edge of each tine.

Still one further valuable object of the invention is to provide an electrical contact that includes tines, at least a portion of which are formed of a high yield strength type of conducting metal.

Briefly, an electrical contact that is constructed in accordance with the principles of the present invention has a split tine socket that is machined out of a high yield strength conducting metal such that neither tine setting nor external helper springs are required. Each tine acts as a two-stage spring and includes a first stage that is thicker near the base of the tine and a second stage that is thinner and which continues away from the base to the tip of the tine. The first stage adds compliance to side loads inflicted by the pin tip when a rocking motion is used to mate the connectors, thereby protecting the socket from permanent deformation or loosening. The outside diameter of the tines is tapered such that when a pin contact is mated, the outside profile becomes nearly cylindrical which maintains a minimal clearance to the inside diameter of a metallic hood which, in turn, constrains the tines and prevents them from loosening by being bent beyond their elastic limit. The inside diameter of the second stage tine is machined with a reverse taper which ensures contact primarily at the tip section of the tine which, in turn, utilizes the entire length of the tine as a spring member and allows higher normal forces, and early establishment of electrical contact integrity during mating and unmating. The distance the tip of the tine moves in and out (radially) during mating is relatively large for any given size of the contact which helps ensure that the normal forces will remain relatively constant regardless of variations that occur in the pin and socket diameters during machining and also due to dimensional changes that are caused by wear. The contact tines are designed so that contact with a mated pin occurs primarily at the tip and along a portion of the longitudinal length at the two inside edges of each tine. The arc on the inside surface of each tine has a smaller radius than the pin and therefore ensures that contact is made along the inside edges of the tine. This provides two deliberate, and relatively high pressure, contact patches that, in turn, provide optimum lines of current flow and which also serve to wipe the contacting surfaces (i.e., the contact patches) during mating and unmating to remove oxides and therefore to help maintain a low contact resistance.

DETAILED DESCRIPTION OF THE INVENTION

Figure 1:
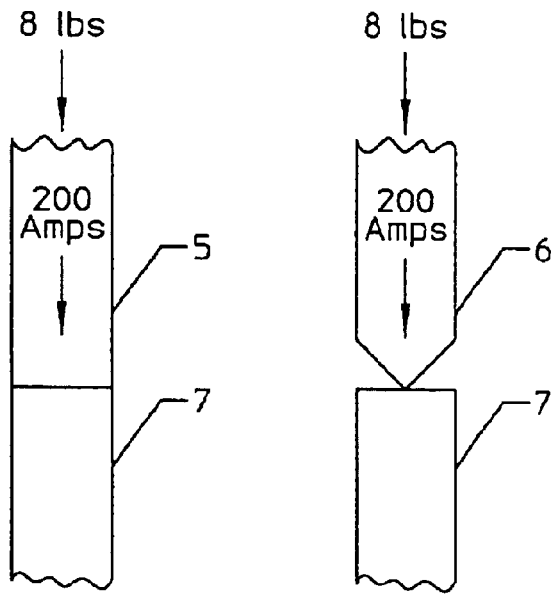
FIG. 1 is a comparison of prior art maximum area contact design theory with a more minimal and deliberate area of contact design theory of the instant invention.

Referring to all of the drawings on occasion and now in particular to FIG. 1 is shown an experimental comparison of the maximum contact theory as typified by a prior art contact pin 5 that is compared in performance with a modified contact pin 6, both pressing down upon a base 7 with an eight pound loading.

The modified contact pin 6 has a limited, yet deliberate area, of contact. Two-hundred amps were allowed to flow through both of these contacts and a temperature rise was observed for each instance.

Prior art contact design utilizes the prior art contact pin 5 for high current applications, believing that maximum contact area is required for high current loading. The limited area of contact of the modified contact pin 6, it is believed, does not permit high current flows and so, based on prior contact design theory, would experience the higher temperature rise. To think that the modified contact pin 6 would fare better in a high current application is counter-intuitive.

Experimentation has shown, however, that the opposite is true, and that the prior art contact pin 5 had a greater rise in temperature than did the modified contact pin 6.

Figure 2:
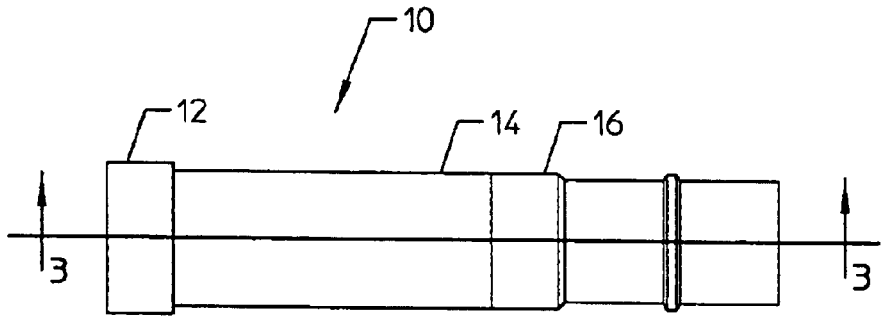
FIG. 2 is a side view of a socket that is used to form the electrical contact.
Figure 3:
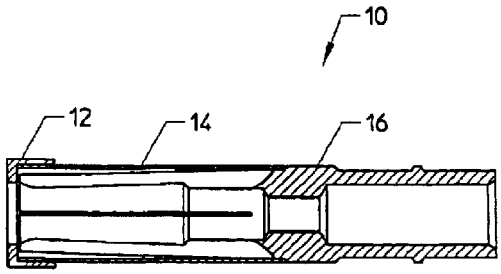
FIG. 3 is a cross-sectional view of the socket of FIG. 2 taken on the line 3—3 in FIG. 2.

Referring now to FIG. 2 is shown a side view of a socket, identified in general by the reference numeral 10, as used with the inventive electrical contact. FIG. 3 is a cross sectional view of the socket 10 of FIG. 2.

The socket 10 is of any preferred size and, although only one is shown, a plurality of sockets 10 are typically used in a socket half portion of a connector (not shown). The use of a plurality of sockets 10 to form a plurality of electrical connections is well known by those possessing ordinary skill in the electrical arts.

The socket 10 includes an insulator tip 12 that is disposed over a hood 14 at a first end thereof. A second opposite end of the hood 14 is disposed around a socket contact 16.

The socket contact 16 extends to the rear of the socket 10 and is adapted for attachment to a wire (not shown). Methods of attaching the socket 10 to the wire are well known in the art. One preferred method of attachment includes crimping of the socket contact 16 around the wire and another common method includes soldering the wire to the socket contact 16. Any preferred method may be used.

Figure 4:
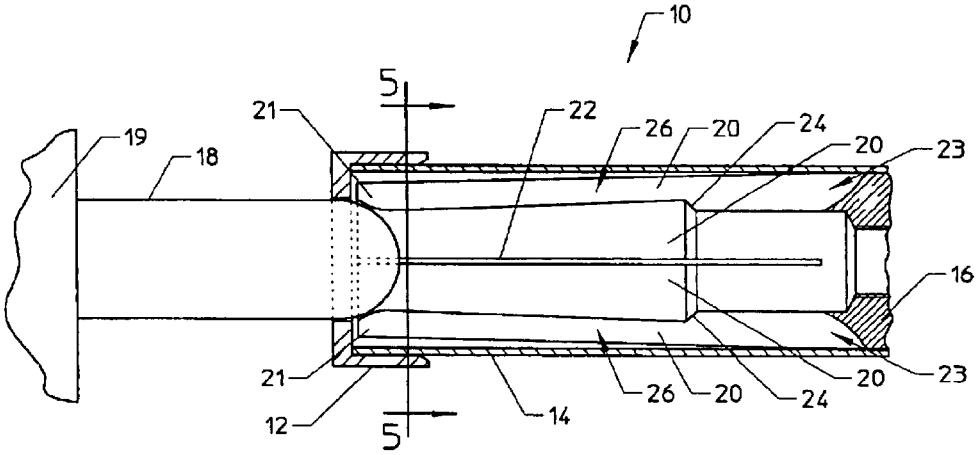
FIG. 4 is an enlarged cross-sectional view of a nose portion of the socket of FIG. 2, as shown within a dashed area, in an unmated condition.
Figure 5:
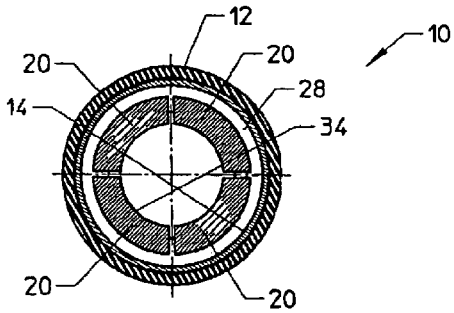
FIG. 5 is a cross sectional view taken on the line 5—5 in FIG. 4.

Referring now to FIG. 4 an enlarged view of the nose portion of the socket of FIG. 3 is shown and also referring on occasion to FIG. 5 where a cross-sectional view taken along the line 5—5 of FIG. 4 is shown, a pin 18 is disposed proximate the socket 10 and prior to the mating of the two together. A pin half of a connector 19 (i.e., that portion that houses the pin(s) 18 mates with the socket half of a connector (that portion that houses the socket(s) to complete the electrical connection).

A plurality of tines 20 are provided which are electrically and mechanically mated with the socket contact 16 or a portion thereof. Each of the tines 20 are separated by a slot 22 that is disposed intermediate each tine 20. Each slot 22 (four if four tines 20 are used) extends substantially the longitudinal length of the tines 20. Therefore, the socket 10 is generally of the type that is commonly referred to as a "split-tine".

The tines 20 are formed of a high yield strength of conductive metal and therefore have an ability to spring back into position. Therefore, the tines 20 need not be set inward nor are external helper springs required to produce a normal force (i.e., a force applied to the tines 20 that urges the tines 20 toward the center of the socket 10 and which helps to ensure electrical conductivity when the pin 18 is mated with the socket 10), as is described in greater detail hereinafter.

Each of the tines 20 includes a first stage, identified in general by the reference numeral 23, that is disposed adjacent the socket contact 16 portion with which it is in electrical contact. The slot 22 intermediate each of the tines 20 terminates in the first stage 23, near the socket contact 16 portion. Accordingly, the tines 20 are each joined together in a common area of the first stage 23 proximate the socket contact 16.

A shoulder 24 tapers outward and reduces the thickness of the tine 20 down to a second stage, identified in general by the reference numeral 26. The second stage 26 extends from the shoulder 24 toward the insulator tip 12 and is thinner than the first stage 23. The second stage 26 terminates at a tip 21 of the tine 20.

Accordingly, the first and second stages 23, 26 of each tine 20 function as a two stage spring that tends to supply the necessary normal force to urge the tip 21 of the tine 20, generally, a limited amount toward the center of the socket 10. The high yield strength metal allows each stage 23, 26 of the tine 20 to function as a more capable and durable spring.

The tines 20 are machined so as to provide a natural offset of the tip 21 toward the center of socket 10. This ensures that when initial contact of the pin 18 is made with the tine 20, that it is the tip 21 of the tine 20 that first makes contact with the pin 18.

The first stage 26 adds compliance (i.e., an ability to flex within the normal operating range of the first stage 26 as a spring). This is useful to protect the socket 10 from permanent deformation or loosening in response to side loads that are inflicted by the pin 18 upon the tines 20 when a rocking motion is used to insert the pin half of a connector 19 into the socket half of a connector.

The hood 14 limits the maximum radial extension that is possible for each tine 20, thereby ensuring that not even an excessive rocking motion by the pin(s) 18 can displace the tines 20 so far that any of them can become permanently deformed or loosened. Accordingly, the ability to apply a normal force by the tip 21 of the tine 20 upon the pin 18 for the useful life of the socket 10 is ensured.

In the unmated state, the outside diameter of the tines 20 is less than the inside diameter of the hood 14, which provides a gap 28 therebetween. The outside diameter of the tines 20 is also tapered, so that when the socket 10 is fully mated with the pin 18, the outside profile of the tines 20 becomes nearly cylindrical along the entire longitudinal length thereof. This provides a minimal clearance (i.e. the gap 28) in the mated state between the outside of the tines 20 and inside diameter of the hood 14. This, in turn, constrains the tines and prevents them from loosening. The hood 14 is preferably formed of a metallic material.

The inside diameter of the second stage 26 of each tine 20 is machined with a reverse taper (i.e., the inside diameter of each tine 20 is greater proximate the shoulder 24 than it is proximate the tip 21 or, stated another way, the second stage 26 of the tine 20 itself is thicker at the tip 21 than it is at the shoulder 24).

Figure 6:
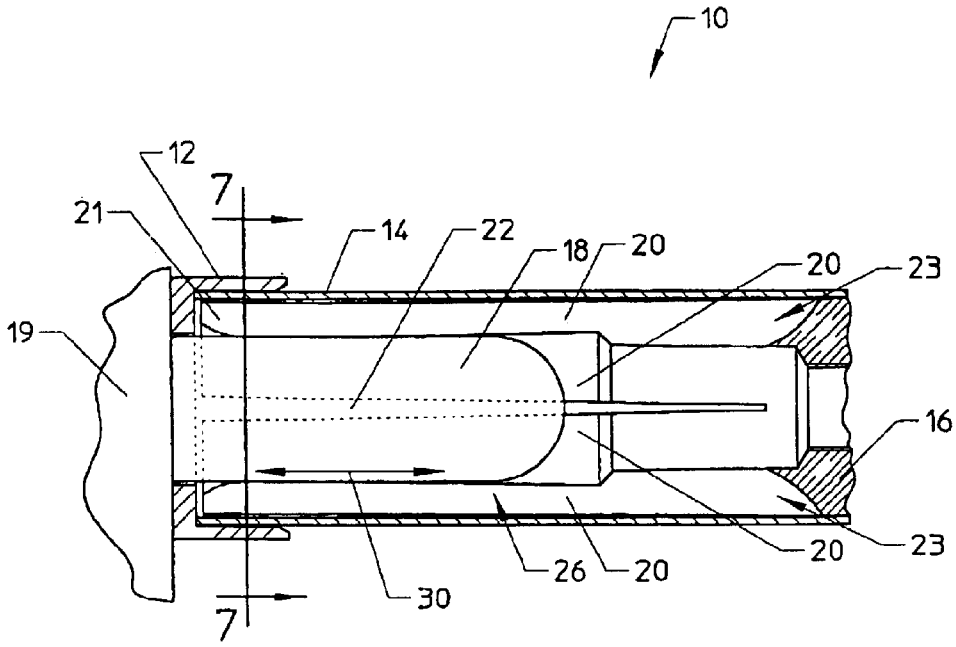
FIG. 6 is an enlarged cross-sectional view of a nose portion of the socket of FIG. 2, as shown within a dashed area, in a fully mated condition.

Referring now also to FIG. 6, the pin 18 is shown mated fully inside of the socket 10.

The reverse taper, together with the natural offset of the tip 21 toward the center of socket 10, ensures that when the pin 18 begins to mate with the socket 10, it is primarily at the tip 21 area of the tines that contact first occurs and that this "patch" of contact, identified in general by arrow 30, is maintained throughout the pin 18 insertion portion of the mate/unmate cycle and also during pin 18 removal.

It is also apparent that because contact occurs primarily at the tip 21 of each tine 20, the entire length of the tine is utilized as a two-stage spring member and allows for higher normal forces to be designed into the socket 10 while minimizing any chance that side loads will result in permanent yielding.

An additional benefit that is provided is that proper normal force, and therefore electrical contact integrity, is established early on in the mating stroke and is maintained even after partial unmating has occurred.

There is another significant benefit that is provided by this configuration. As stated hereinabove, the normal force is provided by each tine 20, which functions as a long two stage spring. The distance the tip 21 of the tine 20 moves radially upon mating is the amount of "spring travel" and this, for any given size of the socket 10, is relatively large.

Accordingly, the normal force that is provided is less dependent on variations of the outside diameter of the pin 18 and the inside diameter of the hood 14 of the socket 10 that are caused by either machining tolerances or wear over time. Having less critical tolerances decreases manufacturing cost. A more constant normal force regardless of wear helps provide a reliable long lasting electrical contact.

Because the normal force that is provided is less subject to variation, so too are the mate and unmate forces less dependent upon tolerances or wear. Similarly, the voltage drop that can be expected to occur intermediate the tine 20 and the pin 18 is less dependent upon tolerance or wear.

Figure 7:
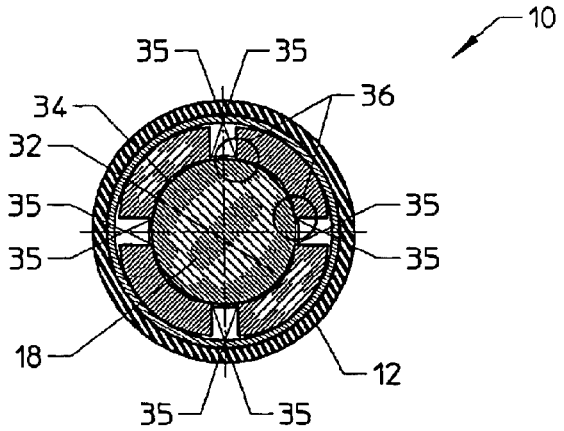
FIG. 7 is a cross sectional view taken on the line 7—7 in FIG. 6.

In actuality, there are two patches 30 of contact that occur intermediate each tine 20 and the pin 18. Referring now also to FIG. 7, the pin 18 includes a radius 32 that is greater than an inside radius 34 of each of the tines 20.

Referring back momentarily to FIG. 5, when the tines 20 are in the normally closed or unmated state, it can be seen that the inside radius 34 very nearly forms a circle. Therefore, when the tines 20 are extended out (as in FIG. 7), they are forced to form a much larger circle around the pin 18 (which has the larger radius 32 while each tine retains its smaller inside radius 34).

Accordingly, each tine 20 makes contact primarily with the pin 18 at each of its two inside edges 35, as is shown inside of two circles 36. This is repeated for each tine 20. Each of the two edges 35 per tine 20 form a patch of contact area that extends for a portion of the longitudinal length of the tine 20 as shown by the arrow 30.

During insertion and removal of the pin 18 from the socket 10, each tine 20 wipes the pin 18 along its two edges 35. The edges 35 effectively utilize the normal force supplied by the spring action of the tines 20 to maximize contact forces that occur at the two edges 35 of each tine 20.

If there are four tines 20 in the socket 10, then there would be eight edges 35 in the socket 10, each edge 35 of which is adapted to provide positive electrical contact intermediate the tines 20 and the pin 18 and to do so at a higher pressure (for any given normal force than prior art designs) being applied to the pin 18 by the tines 20.

Furthermore, it can now be controlled and therefore predicted where electrical contact will physically occur and therefore where current flow will occur. It will occur primarily along the two edges 35 of each tine 20 and primarily toward the tip 21 of each tine 20.

The edges 35 also serve to mechanically wipe the contact surfaces, thereby removing any oxidation that forms on either the pin 18 or on the edges 35 themselves or both. The higher pressure (in pounds per square inch for any given normal force) that is applied at the edges 35 helps to more effectively clean the contact surfaces. This ensures high reliability especially over time or in those types of harsh environments that tend to produce considerable oxidation.

The electrical contact that is provided by the edges 35 also serves to create two parallel lines of current flow that are optimally configured to run longitudinally inward and up the tine 20, exactly as is physically desired.

When the pin 18 is fully inserted into the socket 10, each slot 22 expands accordingly to accommodate the radial extension of each tine 20. When fully inserted, the pin 18 does not enter into the socket 10 beyond the first stage 26 of the tines 20.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

The inside radius 34 of each of the tines 20 intermediate the two patches 30 of contact includes an arc as an inherent part thereof. A straight line connecting any two points of the arc includes a chord. It is noted that the chord of the tines 20 is always disposed on a side of the tines 20 that is closest to the pin 18.

What is claimed is:

1. An electrical contact of the type in which a socket is provided that includes a plurality of tines, each of said plurality of tines adapted to extend radially away from a center, wherein the improvement comprises:

providing an inner arc of each of said plurality of tines that includes a radius that is less than the radius of a pin that said contact is adapted to mate with and wherein a chord across said inner arc is disposed on a same side of said at least one of said plurality of tines as is said pin.

2. An electrical contact of the type in which a socket is provided that includes a plurality of tines, each of said plurality of tines adapted to extend radially away from a center, wherein the improvement comprises:

providing at each of said plurality of tines a first stage proximate a base that includes a first inner diameter and a second stage that is disposed at the base at one end thereof and which extends therefrom to a distal end and where the second stage includes a second inner diameter at said one end thereof that is greater than the first inner diameter and where said second stage includes a reverse inner taper whereby the inner diameter of the second stage progressively decreases as it progresses toward said distal end and wherein each tine includes an inner arc that includes a radius that is less than the radius of a pin that said contact is adapted to mate with and wherein a chord across said inner arc is disposed on a same side of said at least one of said plurality of tines as is said pin.

3. An electrical contact, comprising:

(a) a socket;

(b) a plurality of tines disposed in said socket, at least a portion of each of said tines formed of a high yield strength of metal;

(c) means for connecting a wire to said socket; and wherein each tine includes an inner arc that includes a radius that is less than the radius of a pin that said contact is adapted to mate with and wherein a chord across said inner arc is disposed on a same side of said at least one of said plurality of tines as is said pin.

4. The electrical contact of claim 3 wherein each of said tines includes a first stage and a second stage, said first stage having a first wall thickness that is thicker than a second wall thickness of said second stage that is disposed proximate to said first stage and which extends therefrom to a tip of each tine.

5. The electrical contact of claim 4 wherein each of said tines of said second stage includes a reverse taper whereby said tines include a first inside diameter at said wall thickness that is greater than the inside diameter of said first stage, and wherein said reverse taper includes progressively smaller inside diameters as said second stage progresses toward said tip.

6. The electrical contact of claim 3 wherein when said pin is inserted into said socket, said plurality of tines extend radially away from a center.

7. The electrical contact of claim 6 wherein each of said plurality of tines is adapted to make contact with said pin along a portion of the longitudinal length of each of said plurality of tines at a pair of edges of said inside arc proximate a tip of each of said tines when said pin is inserted into said socket.

8. The electrical contact of claim 4 wherein each of said plurality of tines includes a set that is machined therein whereby a tip of each of said plurality of tines is normally disposed closer to a center of said socket when said socket is not mated with a pin than is a second end of each of said plurality of tines that is disposed distally from said tip.

9. The electrical contact of claim 2 wherein each of said plurality of tines includes a first outside diameter that is proximate a tip and a second outside diameter that is greater than said first outside diameter, said second outside diameter being is disposed at a distal end from said tip, and wherein each of said plurality of tines includes a progressive increase in the outside diameter from said tip to said distal end.

10. The electrical contact of claim 9 wherein said socket includes a hood having a predetermined inside diameter that surrounds said plurality of tines, and wherein when a pin is mated inside of said socket, said plurality of tines extend radially outward a greater amount at said tip than at said distal end, and wherein a gap that exists intermediate said plurality of tines and said inside diameter of said hood is substantially identical along a longitudinal length of said plurality of tines.

* * * * *